US005838642A

United States Patent [19]

Tully

[11] Patent Number: 5,838,642

[45] Date of Patent: Nov. 17, 1998

[54] WRIST SWEATBAND WITH WATCH

[76] Inventor: Patricia A. Tully, 1605 Erin, Apt. 4, Monroe, La. 71201

[21] Appl. No.: 833,918

[22] Filed: Apr. 10, 1997

[51] Int. Cl.[6] ..... G04B 37/00; A44C 5/00

[52] U.S. Cl. ..... 368/282; 368/286; 224/171

[58] Field of Search ..... 368/276, 281, 368/282, 283, 286; 224/164, 165, 171, 176, 180, 182

[56] References Cited

U.S. PATENT DOCUMENTS

| | | | |
|---|---|---|---|
| D. 281,674 | 12/1985 | Novak | D10/31 |
| 1,857,195 | 5/1932 | Karpf . | |
| 2,249,550 | 7/1941 | Williams | 58/105 |
| 2,344,136 | 3/1944 | Dressen | 58/105 |
| 2,649,230 | 8/1953 | Thompson | 368/286 |
| 4,103,808 | 8/1978 | Hallman et al. | 224/168 |
| 4,277,842 | 7/1981 | Richards | 368/282 |
| 4,916,679 | 4/1990 | Agnello | 368/283 |
| 5,332,135 | 7/1994 | Fletcher | 224/164 |

FOREIGN PATENT DOCUMENTS

| | | | |
|---|---|---|---|
| 2249709 | 5/1992 | United Kingdom | 368/282 |

*Primary Examiner*—Vit W. Miska
*Attorney, Agent, or Firm*—John M. Harrison

[57] ABSTRACT

A wrist sweatband which includes a sports-type watch removably fastened to the sweatband. In a preferred embodiment the wrist sweatband with watch is characterized by an elastic, typically cotton, sweatband having a pair of pile element strips of a loop-pile fastener sewn thereto and a loop element strip of the loop-pile fastener extends from each pile element strip. The free end of each loop element strip is extended around a corresponding band attachment pin provided on the watch and each loop element strip is then caused to engage the corresponding pile element strip of the loop-pile fastener, to securely and yet removably, attach the watch to the sweatband. In another embodiment the loop element of a loop-pile fastener is provided on the bottom of the watch for engaging the pile element of the loop-pile fastener, sewn to the sweatband. In still another embodiment a female snap is provided on the sweatband for receiving a companion, male snap provided on the bottom of the watch. Alternatively, a buckle can be used to removably attach the watch to the sweatband.

3 Claims, 2 Drawing Sheets

FIG. 1
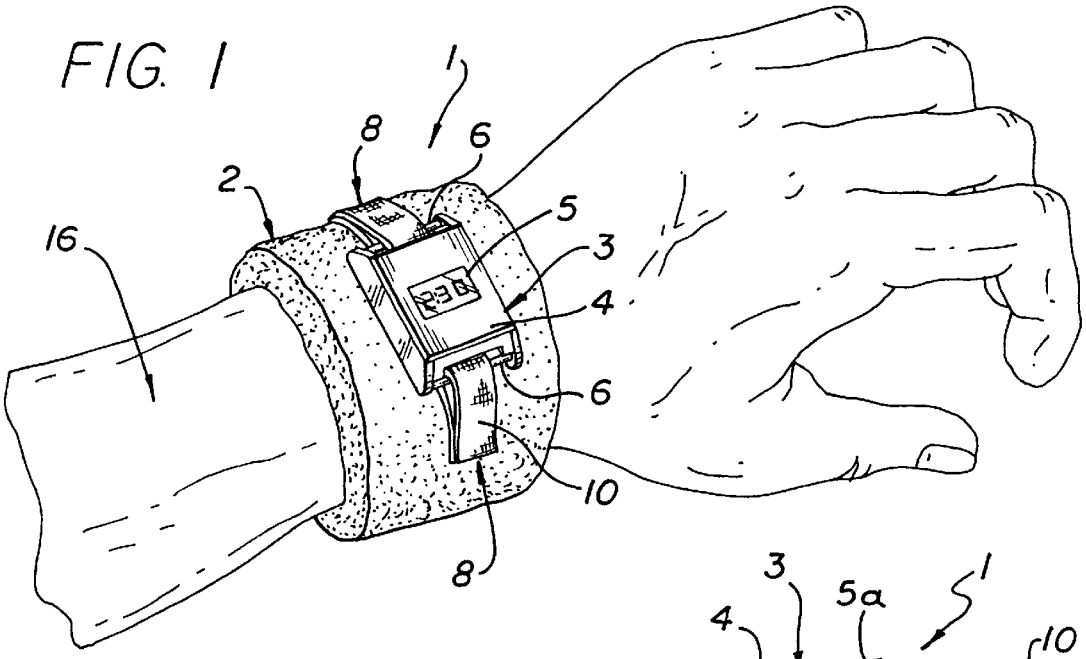
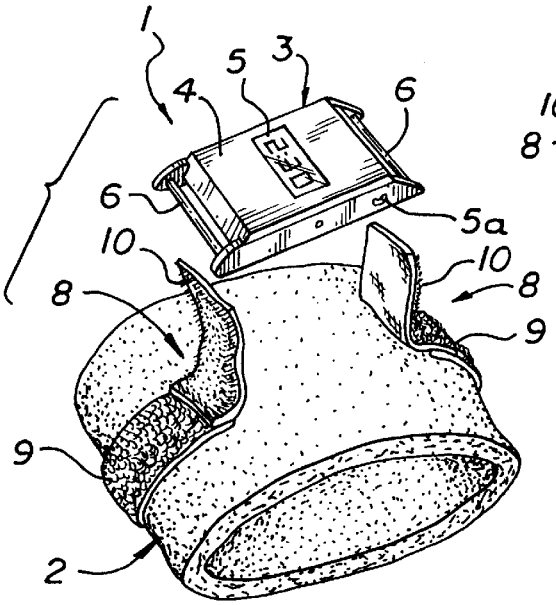
FIG. 2
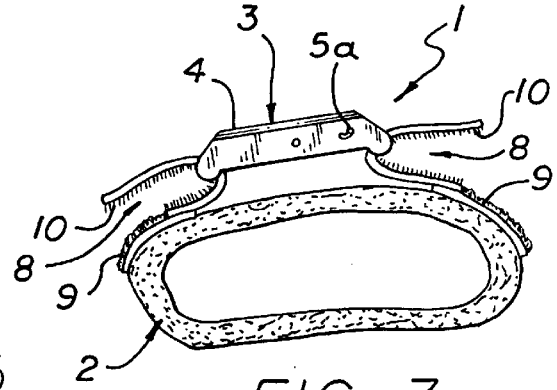
FIG. 3
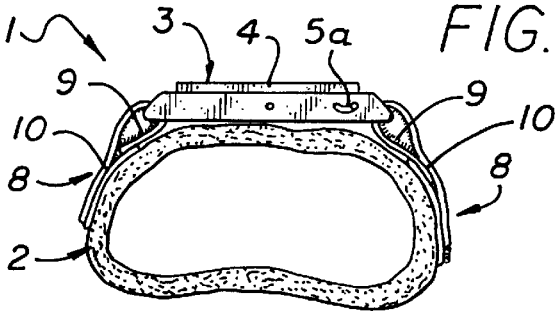
FIG. 4
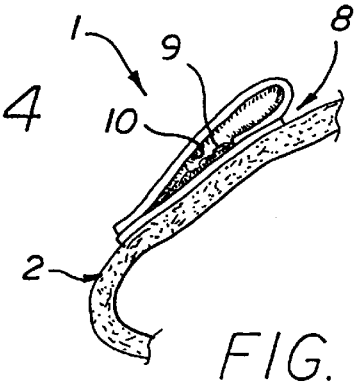
FIG. 5

WRIST SWEATBAND WITH WATCH

BACKGROUND OF THE INVENTION

1. Field of the Invention

This invention relates to sweatbands and more particularly, to a wrist sweatband which includes a sports-type watch removably fastened to the sweatband by various devices to facilitate washing the sweatband independently of the watch when the sweatband becomes dirty or soiled through use. In a preferred embodiment a pair of pile element strips of a loop-pile fastener are sewn to the surface of the sweatband, and one end of a loop element strip of the loop-pile fastener is sewn to the corresponding pile element strip. The free end of each loop element strip is extended around a corresponding, standard band attachment pin which spans each end of the watch and each loop element strip then caused to engage the corresponding pile element strip of the loop-pile fastener, to securely and yet removably, fasten the watch on the sweatband. In another embodiment a female snap member is provided on the sweatband for removably receiving a companion male snap provided on the bottom of the watch, and in still another embodiment the pile element of a loop-pile fastener is provided on the bottom of the watch for removably engaging the loop element of the loop-pile fastener, sewn to the sweatband. Further in the alternative, a buckle can be attached to the sweatband and engages the watch to removably secure the watch to the sweatband.

Athletes and exercisers sometimes wear elastic, typically cotton sweatbands on their wrists in order to absorb excess sweat or perspiration from the arms during vigorous exercise or sports activity. Wearing a wrist watch during such activity is generally undesirable, particularly when the wristband of the watch is leather, since the resulting sweat on the wrist soils the wristband and additionally causes the watch face to slide from view of the athlete or exerciser. The wrist sweatband with watch of this invention provides a watch which always remains in viewing position on the sweatband during vigorous exercise or sports activity, and which can be easily removed from the sweatband to facilitate washing the sweatband when it becomes soiled or dirty as a result of use.

2. Description of the Prior Art

Various devices are known in the art for protecting a wrist watch from water, dirt or other contaminants. U.S. Pat. No. 1,857,195, dated May 10, 1932, to Alfred H. Karpf, describes a "Wrist Watch Protector" characterized by a flexible, transparent sleeve which is fitted on the wrist of the watch wearer and seals the watch from water and dirt. U.S. Pat. No. 2,249,550, dated Jul. 15, 1941, to L. C. Williams, discloses a "Wrist Watch Protector" characterized by a flexible tube or sleeve which fits on the wrist and covers the worn wrist watch, with the ends of the sleeve forming a seal with the skin to protect the watch from dirt or water. Another "Wrist Watch Protector" is detailed in U.S. Pat. No. 2,344,136, dated Mar. 14, 1944, to Harold V. Dressen. The watch protector is characterized by a band of non-elastic material such as leather, having a pair of elastic cords incorporated in the band for contracting the band against the skin around a wrist watch worn on the wrist, thereby protecting or sealing the watch from dirt or water. U.S. Pat. No. 4,277,842, dated Jul. 7, 1981, to David Richards, describes a "Protective Watch Cover" characterized by an elongated, flexible strip having a transparent, plastic window in the middle thereof, which is fitted over the face of a worn wrist watch and the ends of the strip are fastened together around the watch to protect the band and watch face from scratching. U.S. Design Patent No. 281,674, dated Dec. 10, 1985, to Mickey Novak, illustrates a "Sweat Band Wrist Watch". A "Sports Watch Protector" is disclosed in U.S. Pat. No. 4,916,679, dated Apr. 10, 1990, to Mark S. Agnello. The watch protector is characterized by an elastic band which includes a central aperture for receiving the face of a worn wrist watch and the band is fitted around the wrist band of the watch to prevent the watch from falling off the wearer's wrist during sports or other activities.

An object of this invention is to provide a sweatband having a watch which is removably fastened to the sweatband to facilitate washing the soiled sweatband independently of the watch.

Another object of this invention is to provide a wrist sweatband which includes a sports-type watch removably fastened to the sweatband, wherein the face of the watch remains in viewing position on the sweatband to the wearer during vigorous exercise or sports activities.

Still another object of this invention is to provide a wrist sweatband with watch characterized by an elastic, typically cotton sweatband having a pair of pile element strips of a loop-pile fastener sewn to the sides, respectively, of the sweatband and the loop element strip of the loop-pile fastener extends from each pile element strip, wherein each loop element strip is first extended around respective band attachment pins spanning the ends of the watch and then caused to engage the corresponding pile element strip of the loop-pile fastener, in order to securely, yet removably, fasten the watch to the sweatband.

Yet another object of this invention is to provide a wrist sweatband with watch characterized by an elastic sweatband having a female snap attached thereto, for receiving a companion, male snap provided on the bottom of a sports-type watch and removably and securely fastening the watch on the sweatband.

Another object of this invention is to provide a wrist sweatband with watch characterized by a pile element of a loop-pile fastener provided on an elastic sweatband for removably engaging the loop element of the loop-pile fastener provided on the bottom of a sports-type watch, to facilitate removably and securely mounting the watch on the sweatband during vigorous exercise or sports activities performed by the person wearing the sweatband.

SUMMARY OF THE INVENTION

These and other objects of the invention are provided in a wrist sweatband with watch characterized by an elastic sweatband which is worn on the wrist and includes a typically sports-type watch removably fastened to the sweatband, in order to facilitate washing the soiled sweatband independently of the watch. In a preferred embodiment a pair of first element strips of a loop-pile fastener are sewn to the sides, respectively, of the sweatband and one end of a second element strip of the loop-pile fastener is sewn to the corresponding first element strip, the free end of which second element strip is first extended around a corresponding band attachment pin on the watch and each second element strip then caused to engage the corresponding first element strip of the loop-pile fastener, to secure the watch on the sweatband. In another embodiment a first snap element is attached to the sweatband for removably receiving a companion, second element snap provided on the watch and in still another embodiment, the first element of a loop-pile fastener is provided on the sweatband for engaging the second element of the loop-pile fastener, provided on the watch. Alternatively, a buckle can be attached to the sweatband for removably engaging the watch.

BRIEF DESCRIPTION OF THE DRAWINGS

The invention will be better understood by reference to the accompanying drawings, wherein:

FIG. 1 is a perspective view of a preferred embodiment of the wrist sweatband with watch of this invention in functional position on the wrist of a user;

FIG. 2 is a perspective, exploded view of the wrist sweatband with watch illustrated in FIG. 1;

FIG. 3 is an end exploded view, of the wrist sweatband with watch, more particularly detailing a preferred, loop-pile fastener technique for removably attaching the watch component to the sweatband component of the invention;

FIG. 4 is an end view of the wrist sweatband with watch illustrated in FIG. 3, with the watch component secured to the sweatband component;

FIG. 5 is an end view, partially in section, of the wrist sweatband with watch illustrated in FIG. 4, with the watch component removed for brevity;

DESCRIPTION OF THE PREFERRED EMBODIMENTS

Figure 6:
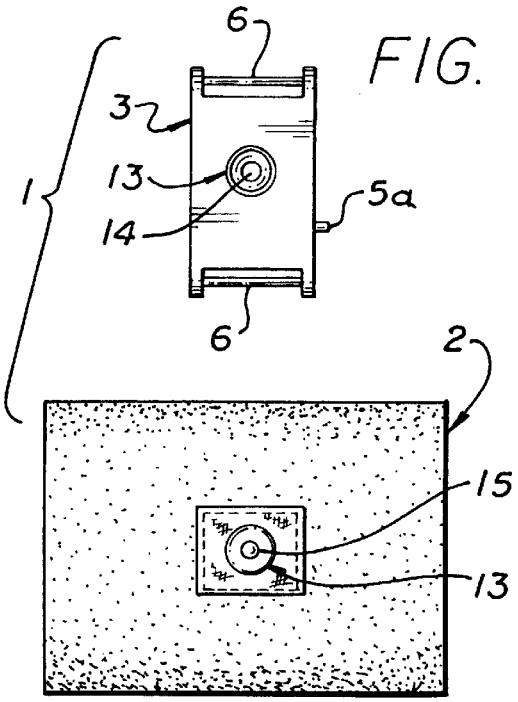
FIG. 6 is a top view of the wrist sweatband and bottom view of the watch, both fitted with snaps for removably attaching the watch to the sweatband.

Referring initially to FIGS. 1–5 of the drawings, in a preferred embodiment the wrist sweatband with watch of this invention is generally illustrated by reference numeral 1. The wrist sweatband with watch 1 includes a tubular, elastic, typically cotton, standard or conventional sweatband 2, which is worn on the wrist 16 of an athlete or exerciser, for example, in conventional fashion, as illustrated in FIG. 1, for absorbing excess perspiration from the skin during physical activity. As illustrated in FIGS. 2–5, the pile element strip 9 of a loop-pile fastener 8 is sewn on each side of the sweatband 2, and one end of a loop element strip 10 of each loop-pile fastener 8 is typically sewn or stitched on the end of each pile element strip 9, as further illustrated in FIG. 3. A standard or conventional, sports-type watch 3, includes a face 4, typically having a digital display 5 for displaying the time, date and seconds, respectively, responsive to successive depression of a display button 5*a*, and is further provided with a pair of band attachment pins 6, which span the respective ends of the watch 3 and conventionally receive the looped ends, respectively, of a wristband (not illustrated) for securing the watch 3 on the wrist 16. Attachment of the watch 3 to the sweatband 2 is effected by first extending the free end of each loop element strip 10 of each loop-pile fastener 8 around the corresponding band attachment pin 6 of the watch 3, as illustrated in FIG. 4, and the loop element strip 10 is then caused to engage the corresponding pile element strip 9 of each loop-pile fastener 8, as illustrated in FIGS. 1–5, to securely, yet removably, fasten the watch 3 on the sweatband 2. As the sweatband 2 and attached watch 3 are worn on the wrist 16, the watch 3 remains in viewing position on the sweatband 2 to the exerciser or athlete, as the sweatband 2 absorbs excess perspiration on the skin of the wrist 16, during activity. Removal of the watch 3 to facilitate washing the sweatband 2, is effected by first disengaging the loop element strips 10 from the respective pile element strips 9 of the loop-pile fasteners 8, as illustrated in FIG. 3, and then lifting the watch 3 from the loop-pile fasteners 8.

Figure 7:
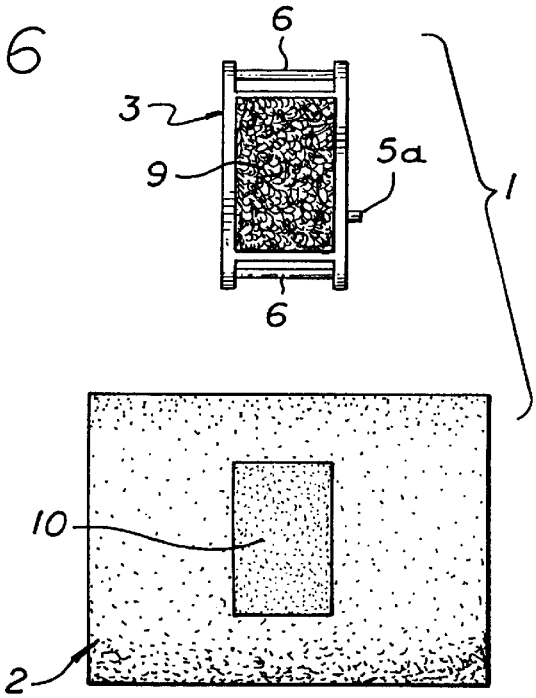
FIG. 7 is a top view of the wrist sweatband and bottom view of the watch of this invention, more particularly detailing an alternative loop-pile technique for removably fastening the watch component to the sweatband component.

Referring next to FIGS. 6 and 7 of the drawings, in other embodiments the watch 3 is removably secured to the sweatband 2 by means of snaps 13 (FIG. 6), including a male snap 15, which is typically stitched or otherwise attached to the sweatband 2 and receives a companion, female snap 14, glued or otherwise mounted on the bottom surface of the watch 3. The attachment illustrated in FIG. 7 includes a pile element strip 9, attached to the watch 3 and a loop element strip 10, attached to the sweatband 2.

Figure 8:
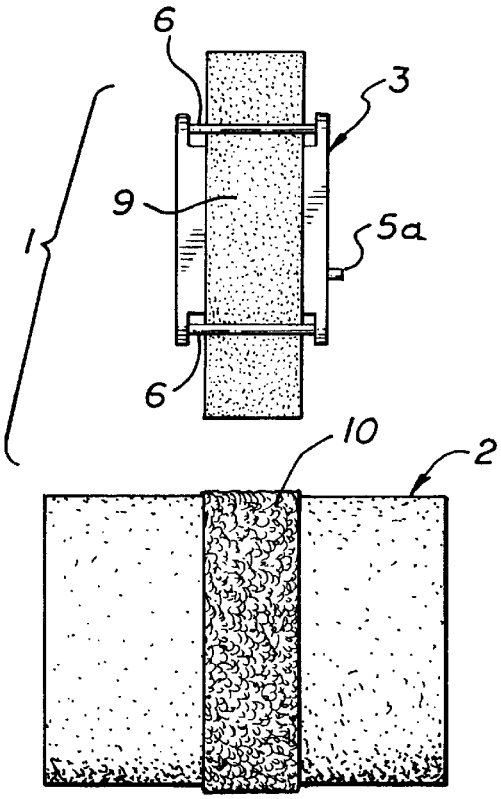
FIG. 8 is a top view of the sweatband and bottom view of the watch, more particularly detailing still another loop-pile attachment mechanism.

In still another embodiment illustrated in FIG. 8, a larger loop element 10 of a loop-pile fastener 8 is attached to the bottom surface of the watch 3 for removably engaging the like-sized pile element 9 of the loop-pile fastener 8, provided on the sweatband 2.

Figure 9:
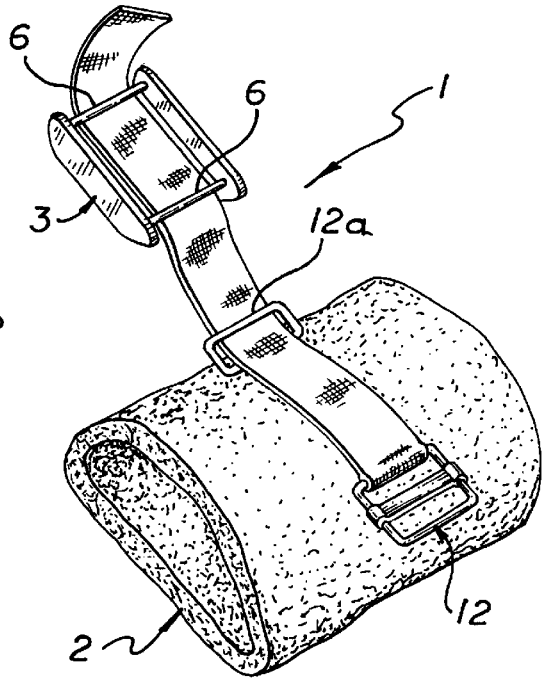
FIG. 9 is an exploded view of still another embodiment of the wrist sweatband with watch of this invention, illustrating an alternative buckle fastener technique for removably fastening the watch component to the sweatband component.

FIG. 9 details a buckle 12, with a strap 11 extending through a buckle loop 12*a,* attached to the sweatband 2, wherein the strap 11 extends through the buckle loop 12*a* and around the band attachment pins 6, to engage the buckle 12.

It will be appreciated by those skilled in the art that any type of watch 3 having band attachment pins 6 may be fastened to the sweatband 2 provided with the loop-pile fasteners 8 described above with respect to the first embodiment illustrated in FIGS. 1–5 of the drawings. It will be further appreciated that any type of watch 3 can be fastened to the sweatband 2 provided with the snaps 13, described above with respect to FIG. 7, or the loop-pile fastener 8, described above with respect to FIG. 8. Moreover, other types of fasteners such as straps and buckles (FIG. 9) or the like, can be used to secure the watch on the sweatband 2, as desired.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A wrist sweatband for a watch having a pair of band attachment pins, said wrist sweatband comprising a sweatband provided on the wrist, a watch seated on said sweatband, a pair of pile element strips of a loop-pile fastener provided on said sweatband and loop element strips of said loop-pile fastener extending from said pile element strips, respectively, of said loop-pile fastener, and loop element strips of said loop-pile fastener extended around the band attachment pins, respectively, and caused to engage said pile element strips, respectively, of said loop-pile fastener for removably fastening the watch to said sweatband.

2. A wrist sweatband for a watch having a pair of band attachment pins, said wrist sweatband comprising a sweatband provided on the wrist, a wrist watch seated on said wrist watch and a pair of loop element strip of a loop-pile fastener provided on said sweatband and pile element strips of said loop-pile fastener extending from said loop element strips, respectively, of said loop-pile fastener, and said pile element strips of said loop-pile fastener extending around the band attachment pins, respectively, and caused to engage said loop element strips, respectively, of said loop-pile fastener for removably fastening the wrist watch to said sweatband.

3. A wrist sweatband for a wrist watch having a pair of loop element band attachment pins, said wrist watch comprising a continuous sweatband; a pair of loop element strips of a loop-pile fastener attached to said sweatband and pile element strips of said loop-pile fastener extending from said element strips, respectively, of said loop-pile fastener, wherein said pile element strips of said loop-pile fasteners are extended around said band attachment pins, respectively, and caused to engage said loop element strips, respectively, of said loop-pile fastener, to removably secure the wrist watch on said sweatband.

* * * * *